US005575421A

United States Patent [19]

Heo

[11] Patent Number: 5,575,421

[45] Date of Patent: Nov. 19, 1996

[54] KNOB OF A CORRUGATED CARDBOARD PACKING BOX

[75] Inventor: Se-Hwan Heo, Seoul, Rep. of Korea

[73] Assignee: Goldstar Co., Ltd., Seoul, Rep. of Korea

[21] Appl. No.: 585,755

[22] Filed: Jan. 16, 1996

Related U.S. Application Data

[63] Continuation of Ser. No. 366,653, Dec. 30, 1994, abandoned.

[30] Foreign Application Priority Data

Dec. 30, 1993 [KR] Rep. of Korea ..... 1993-31043

[51] Int. Cl.[6] ..... B65D 5/468

[52] U.S. Cl. ..... 229/117.16; 229/199

[58] Field of Search ..... 229/117.13, 117.14, 229/117.16, 117.17, 199

[56] References Cited

U.S. PATENT DOCUMENTS

| | | | |
|---|---|---|---|
| 2,710,135 | 6/1955 | Gaylord | 229/117.16 |
| 3,696,990 | 10/1972 | Dewhurst | 229/117.16 X |
| 4,157,755 | 6/1979 | Gough | 229/117.16 X |
| 4,405,078 | 9/1983 | Dutcher et al. | 229/117.13 |
| 4,718,597 | 1/1988 | Bishop | 229/117.16 |

FOREIGN PATENT DOCUMENTS

| | | | |
|---|---|---|---|
| 481675 | 3/1952 | Canada | 229/117.16 |
| 65068 | 10/1962 | Canada | 229/117.16 |
| 2045825 | 12/1992 | Canada | 229/117.16 |
| 2047520 | 1/1993 | Canada | 229/117.16 |
| 4125777 | 2/1993 | Germany | 229/117.16 |

*Primary Examiner*—Allan N. Shoap
*Assistant Examiner*—Christopher J. McDonald
*Attorney, Agent, or Firm*—Spencer & Frank

[57] ABSTRACT

This invention relates to a knob of a corrugated cardboard packing box which can prevent a danger of an external appearance of a packing box, has a cutting part 103 being cut, a bending part 105 connecting both edges of the cutting part 103, holes 110 formed between both edges of the cutting part and the bending part, for dispersing a stress applied in both edges of the cutting part 103.

1 Claim, 2 Drawing Sheets

KNOB OF A CORRUGATED CARDBOARD PACKING BOX

This is a continuation of application Ser. No. 08/366,653, filed on Dec. 30, 1994 abandoned.

FIELD OF THE INVENTION

The present invention relates to a knob of a corrugated cardboard packing box, more particularly to a knob which can prevent damage to the external appearance of the box.

BACKGROUND OF THE INVENTION

As shown in FIG. 1 and 2, the conventional corrugated cardboard packing box has a knob 4 in which a portion of a solid line 5 is cut and a portion of a dotted line 3 is bent.

In order to use the knob 4, one pushes the cut solid line of the knob 4 from the exterior of the box to its the interior. Then, the portion of the knob 4 is bent at the dotted line so that a knob hole 2 is formed.

However, when a user uses the knob hole 2 to move an article in it, a stress is concentrated in both edges A, A' of the knob portion so that damage of the box is often generated.

As a result, the dotted line which have to be bent naturally is not bent and a connected line 6 of the rupture portions of both edges is bent. So, the conventional packing box has a problem that the appearance of the box is damaged and not elegant.

SUMMARY OF THE INVENTION

Accordingly, the object of the present invention is to provide a knob of a corrugated cardboard packing box to be capable of preventing a damage of an appearance of a packing box.

This object and other objects are achieved by a knob comprising a cutting part being cut, a bending part connecting both edges of the cutting part, holes formed between both edges of the cutting part and the bending part.

DETAILED DESCRIPTION OF THE INVENTION

Referring to an annexed drawings of

Figure 1:
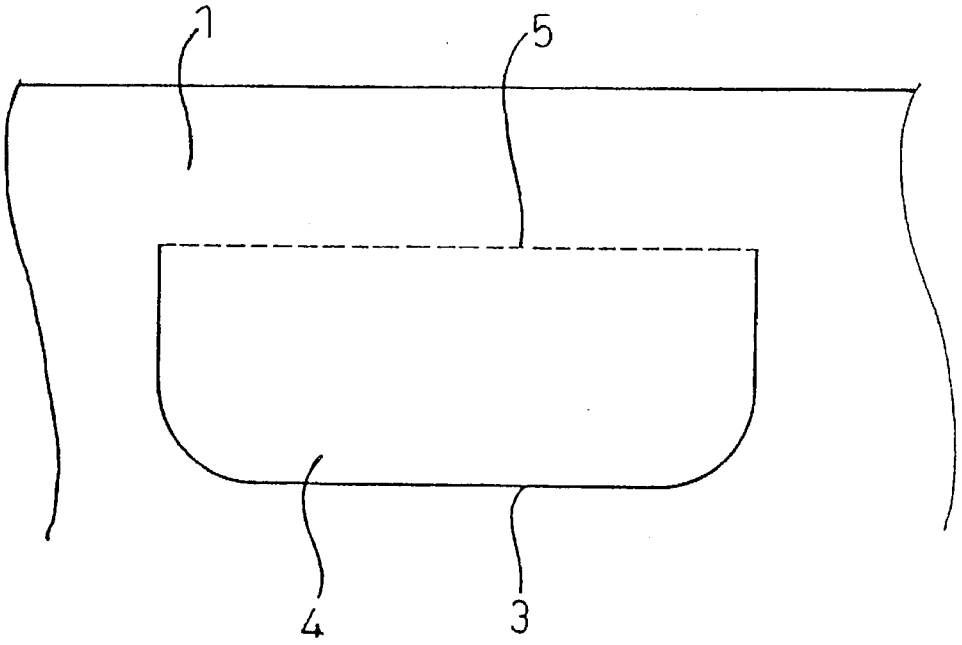
FIG. 1 PRIOR ART
FIG. 1 is a schematic diagram showing a knob part of a packing box in accordance with the conventional art.
Figure 2:
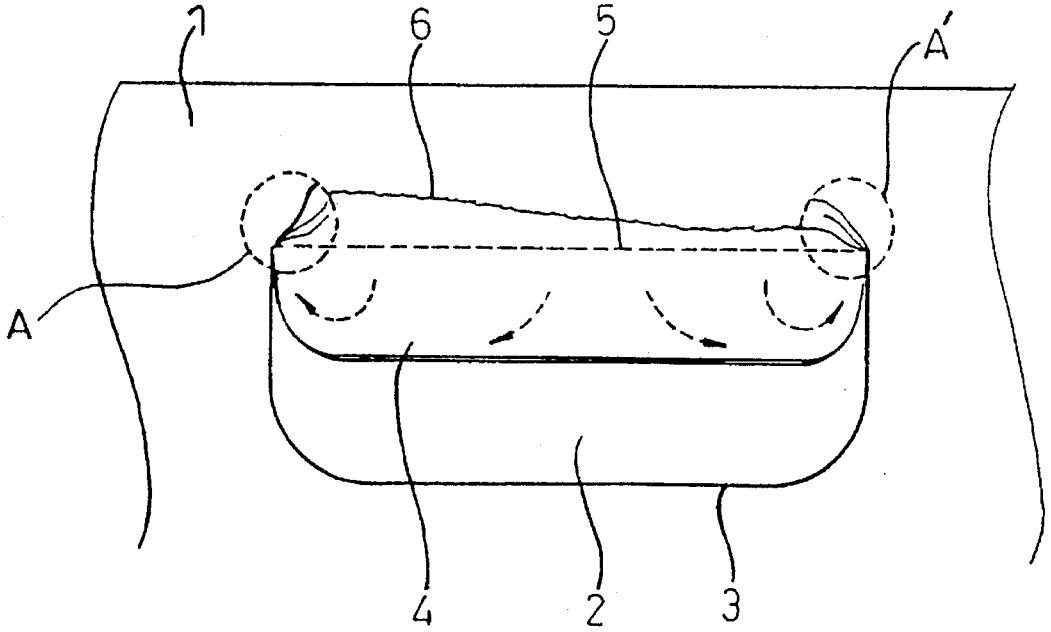
FIG. 2 PRIOR ART
FIG. 2 is a schematic diagram showing a state which the hole of the knob part is formed in accordance with the conventional art.
Figure 3:
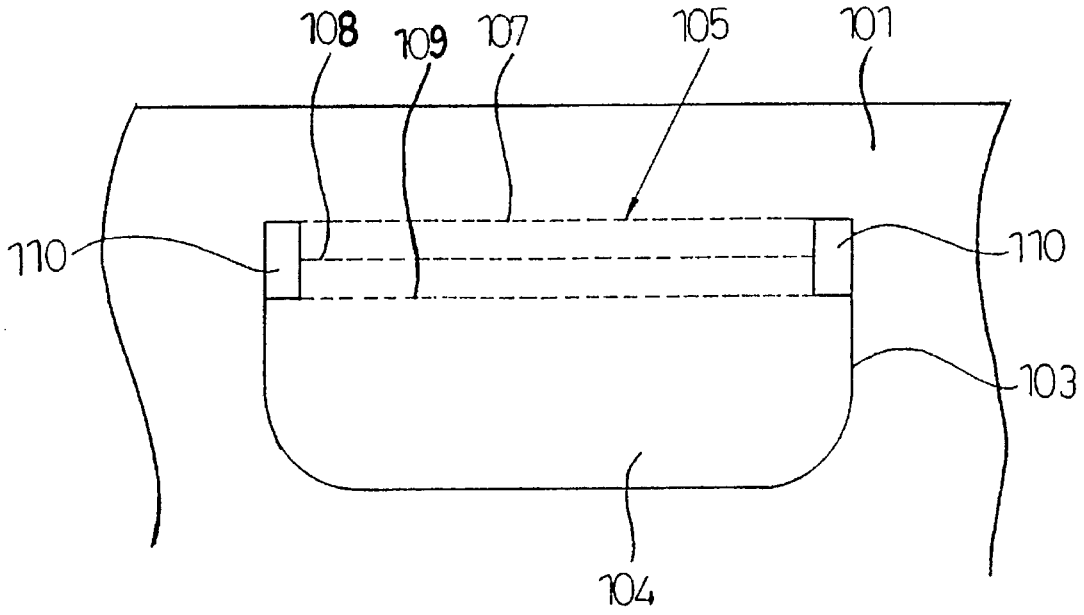
FIG. 3 is a schematic diagram showing a knob part of a packing box in accordance with the present invention.
Figure 4:
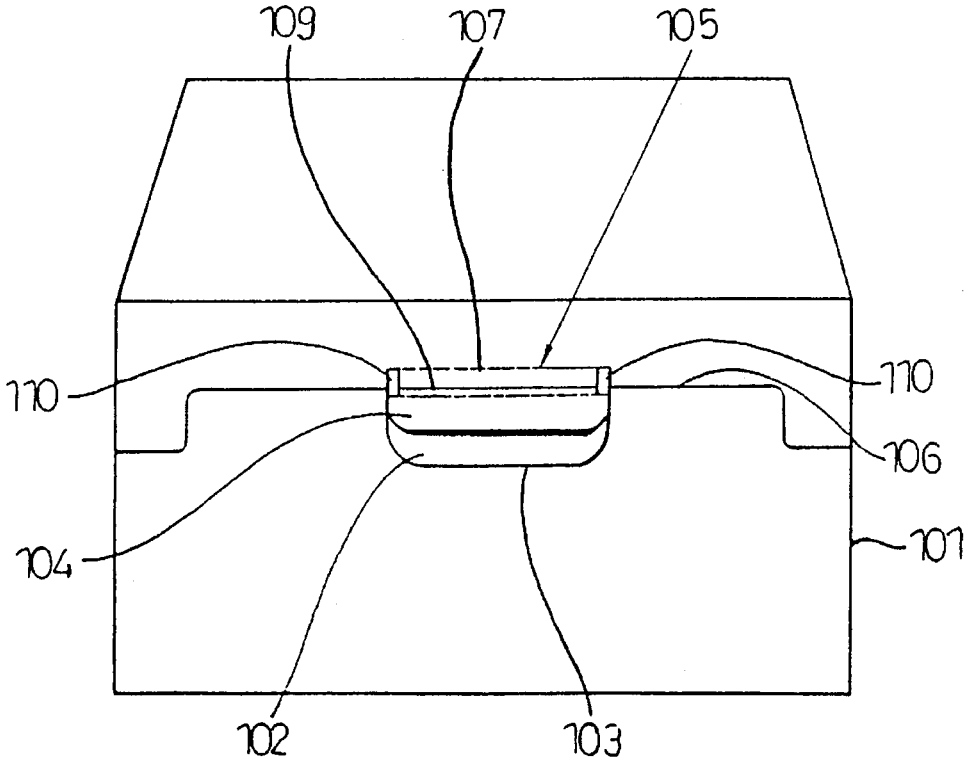
FIG. 4 is a schematic diagram showing a state in which the hole of the knob part is formed.

FIG. 3 and 4, a knob of a corrugated cardboard packing box in accordance with the present invention is described.

As shown in FIG. 3, the present corrugated cardboard packing box has a knob part 104 comprising a cutting part 103 marked as a solid line and a bending part 105 marked as dotted lines and being bent at the dotted lines connecting both ends of said cutting part 103.

A packing segment 106 is established in the inside of the packing box 101, wherein the packing segment 106 is styrofoam for protecting the goods put in the packing box. The packing segment extends from the top of the packing box in a conventional manner whereby edge 106 is a bottom edge.

The bending part 105 includes a first bending part 107 being bent as the knob part 104 is positioned at the low position in comparison with the position of the packing segment 106 positioned at the inside of the packing box 101, a second bending part 108 being bent as the knob part 104 is positioned at a parallel position with the position of the packing segment 106, a third bending part 109 being bent as the knob part 104 is positioned at the high position in comparison with the position of the packing segment 106 and openings 110 formed between both edges of the cutting part 103 and the bending part 105, for dispersing the stress applied at said both edges.

When a user pushes the knob 104 to the inside of the packing box so as to use the knob 104, the solid line part is cut and the dotted line part is bent so that a knob hole 102 is formed.

Because the bent knob part 104 is pushed and adhered closely to the packing segment 106, a user can easily move goods in it.

When the knob part 104 is bent, in case that the bending part 105 is lower than the position of the packing segment 106, the first bending part is bent, in case that the bending part 105 is parallel with the position of the packing segment 106, the second bending part is bent and in case that the bending part 105 becomes higher than the position of the packing segment 106, the third bending part is bent.

Accordingly, the knob of the present invention can prevent a bending at non-desired position.

In addition, the knob of the present invention can prevent a rupture occurring in both edges of the cutting part because the applied stress is dispersed due to the openings.

As described hereinbefore, the present invention maintains a elegant appearance and durability of the packing box.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A knob of corrugated cardboard packing box comprising:

a cutting part being cut and having two edges;

a bending part connecting both edges of said cutting part;

means for dispersing a stress applied in both edges of said cutting part, said means being openings formed between both an edge of the cutting part and the bending part, said bending part comprising:

a first bending part, being bent as a knob part, when said bending part is positioned at a low position in comparison with the position of a packing segment inside the packing box;

a second bending part being bent as the knob part when said bending part is positioned at a substantially parallel position with the position of the packing segment; and a third bending part being bent as the knob part when said bending part is positioned at a high position in comparison with the position of the packing segment, wherein the packing segment is styrofoam for protecting goods put in the packing box.

* * * * *